US007159575B2

(12) United States Patent
Inoue

(10) Patent No.: US 7,159,575 B2
(45) Date of Patent: Jan. 9, 2007

(54) FUEL FEED APPARATUS HAVING INNER SUPPORTING STRUCTURE

(75) Inventor: Masato Inoue, Kariya (JP)

(73) Assignee: Denso Corporation (JP)

( * ) Notice: Subject to any disclaimer, the term of this patent is extended or adjusted under 35 U.S.C. 154(b) by 37 days.

(21) Appl. No.: 11/048,855

(22) Filed: Feb. 3, 2005

(65) Prior Publication Data

US 2005/0178448 A1 Aug. 18, 2005

(30) Foreign Application Priority Data

Feb. 12, 2004 (JP) ..... 2004-035390

(51) Int. Cl.
*F02M 37/04* (2006.01)
*F02M 37/08* (2006.01)

(52) U.S. Cl. ..... 123/509; 123/514; 137/582

(58) Field of Classification Search ..... 123/509, 123/514, 461; 137/571, 574, 582
See application file for complete search history.

(56) References Cited

U.S. PATENT DOCUMENTS 4,989,572 A * 2/1991 Giacomazzi et al. ..... 123/514
5,050,567 A * 9/1991 Suzuki ..... 123/514
5,080,077 A * 1/1992 Sawert et al. ..... 123/514
6,981,490 B1 * 1/2006 Nagata et al. ..... 123/514
2005/0166974 A1 * 8/2005 Hashiguchi ..... 137/571

FOREIGN PATENT DOCUMENTS

JP 2527362 2/1997

* cited by examiner

*Primary Examiner*—Mahmoud Gimie
(74) *Attorney, Agent, or Firm*—Nixon & Vanderhye PC

(57) ABSTRACT

Surplus fuel returns from an engine into the sub-tank through a bellows pipe. A downstream end of the bellows pipe is supported by a sub-tank lid that closes an opening of a sub-tank. One ends of arms engage with the top of a pump module, which includes a fuel pump. The other ends of arms engage with the outer peripheral wall of the sub-tank. Thereby, the arms connect between the pump module and the sub-tank. Surplus fuel flows into the sub-tank through the bellows pipe, and strikes against the arm. Thereby, return fuel, which comes back into the sub-tank, decreases in kinetic energy. Thus, sound and vapor generated from fuel in the sub-tank can be reduced when return fuel comes back into the sub-tank.

24 Claims, 3 Drawing Sheets

FUEL FEED APPARATUS HAVING INNER SUPPORTING STRUCTURE

CROSS REFERENCE TO RELATED APPLICATIONS

This application is based on and incorporates herein by reference Japanese Patent Application No. 2004-35390 filed on Feb. 12, 2004.

FIELD OF THE INVENTION

The present invention relates to a fuel feed apparatus that feeds fuel in a fuel tank to the outside of the fuel tank, the fuel tank accommodating a sub-tank, to which return fuel comes backs.

BACKGROUND OF THE INVENTION

As disclosed in JP-2527362-Y2, fuel feed apparatuses are conventionally known. In the fuel feed apparatuses, a return pipe is inserted into a lid for introducing return fuel. The lid closes an opening of a fuel tank. The return pipe is supported by the lid. Fuel directly returns into the fuel tank through the return pipe. Here, return fuel is surplus fuel, which exceeds a consuming quantity of an engine, out of fuel supplied to the engine (fuel consumption apparatus). A sub-tank is accommodated in a fuel tank and return fuel returns into the sub-tank. The return pipe for introducing return fuel is inserted and fitted into a lid to be supported. The lid closes the opening of the fuel tank. Fuel may directly return into the sub-tank as in JP-2527362-Y2.

The lid, which closes the opening of the fuel tank, may support the return pipe. However, in this structure, the distance between the location, in which the return pipe is supported, and a fuel level in the sub-tank may become large. When the length of the return pipe extending from the location, in which the return pipe is supported, toward the sub-tank is be small, the distance between the lower opening end of the return pipe and a fuel level in the sub-tank becomes large. Accordingly, fuel returning from the return pipe falls violently onto fuel in the sub-tank. As a result, sound of collision generated between return fuel and fuel in the sub-tank becomes loud. Besides, vapor is apt to be generated in fuel in the sub-tank due to return fuel falling in the sub-tank.

The return pipe extends from the location, in which the return pipe is supported by the lid, toward the sub-tank. The length of the return pipe may be increased in order to decrease the distance between the lower opening end of the return pipe and a fuel level in the sub-tank. In this case, a lower portion of the return pipe, which is not supported, may swing due to vibration or the like.

SUMMARY OF THE INVENTION

In view of the foregoing problems, it is an object of the present invention to produce a fuel feed apparatus, in which sound generated by return fuel introduced into a sub-tank is reduced, and vapor generated from fuel in the sub-tank is reduced. It is another object of the present invention to produce a fuel feed apparatus, in which a lower portion of a return pipe extending toward a sub-tank is supported to restrict the return pipe from swinging.

According to the present invention, a fuel feed apparatus pumps fuel in a fuel tank to the outside of the fuel tank. The fuel feed apparatus includes a sub-tank, a sub-tank lid, and a return pipe. The sub-tank is accommodated in the fuel tank. The sub-tank defines an opening. The sub-tank lid covers at least a part of the opening of the sub-tank. Return fuel flows into the sub-tank through the return pipe. The return pipe has a downstream end that is mounted on the upper side of the sub-tank. The sub-tank lid includes a support member that supports the downstream end. Return fuel flows into the sub-tank through the downstream end of the return pipe. Return fuel flows from an internal combustion engine into the sub-tank through the downstream end of the return pipe.

Alternatively, a fuel feed apparatus includes the sub-tank, the sub-tank lid, and a collision member. Fuel flowing into the sub-tank through the return pipe collides against the collision member. The collision member has a collision surface. Fuel, which flows into the sub-tank through the return pipe, collides against the collision surface. The collision surface is arc-shaped. The fuel feed apparatus further includes a pump module and a connection member. The pump module is accommodated in the sub-tank. The pump module includes a fuel pump that pumps fuel in the sub-tank. The connection member connects the pump module with the sub-tank. The connection member serves as the collision member. The connection member is elastic.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS (Embodiment)

Figure 1:
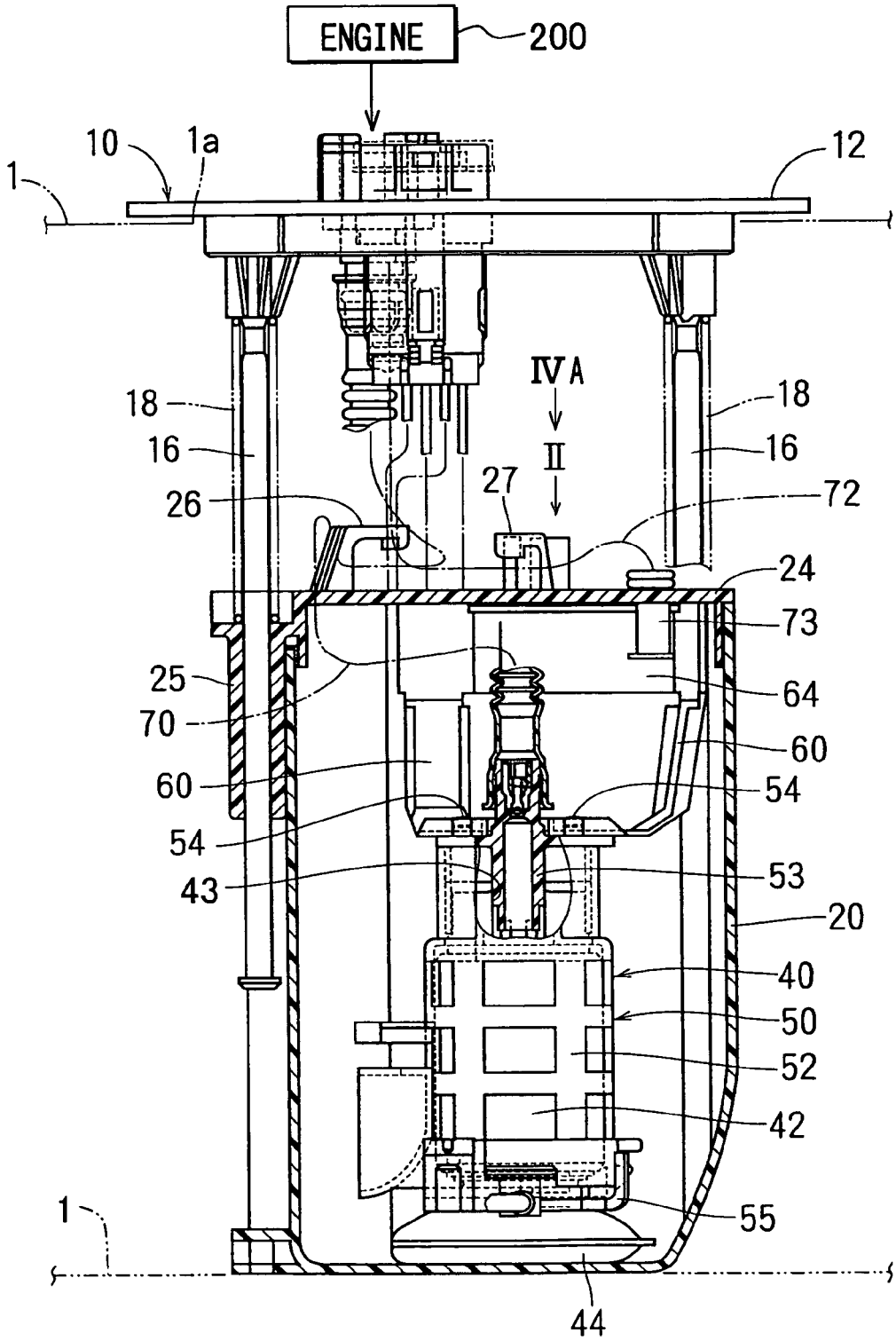
FIG. 1 is a partially cross sectional side view showing a fuel feed apparatus according to an embodiment of the present invention.

As shown in FIG. 1, a lid member 12 of the fuel feed apparatus 10 is formed to be disk-shaped, and latched and mounted onto an upper wall of a fuel tank 1. The fuel tank 1 is made of resin. The fuel tank 1 covers an opening 1*a* formed in the fuel tank 1. The fuel tank 1 may be formed of a metal. Other parts than the lid member 12 of the fuel feed apparatus 10 are accommodated in the fuel tank 1.

A fuel supply portion, a fuel return portion, and an electric connector are provided to the lid member 12. The fuel supply portion supplies fuel, which is discharged from a fuel pump 42 and supplied to the outside of the fuel tank 1 through a bellows pipe 70. Surplus fuel on the side of an engine 200 is introduced into the fuel tank 1 through the fuel return portion. The fuel pump 42 is supplied with electric power via the electric connector and a lead wire.

One ends of metallic pipes 16 are press-fitted into the lid member 12, and the other ends of the metallic pipes 16 are inserted loosely into insertion portions 25 formed in a sub-tank lid 24. Springs 18 bias the lid member 12 and the sub-tank lid 24, i.e., a sub-tank 20 to separate them from each other. The fuel tank 1 made of resin may expand or contract due to a change in internal pressure caused by temperature change and a change in fuel quantity. Even in this case, the bottom of the sub-tank 20 is constantly pushed against the inner wall of the bottom of the fuel tank 1 by the resilient force of the springs 18.

The fuel pump 42, a suction filter 44, a pump casing 50, and the like are accommodated in the sub-tank 20 that is made of resin. The fuel pump 42, the suction filter 44, and the pump casing 50 construct a pump module 40. A fuel filter is mounted in a supply path, which is disposed outside the fuel tank 1 and through which fuel is supplied to the engine 200 from the fuel tank 1. The fuel filter removes foreign matters contained in fuel discharged from the fuel pump 42.

Figure 2:
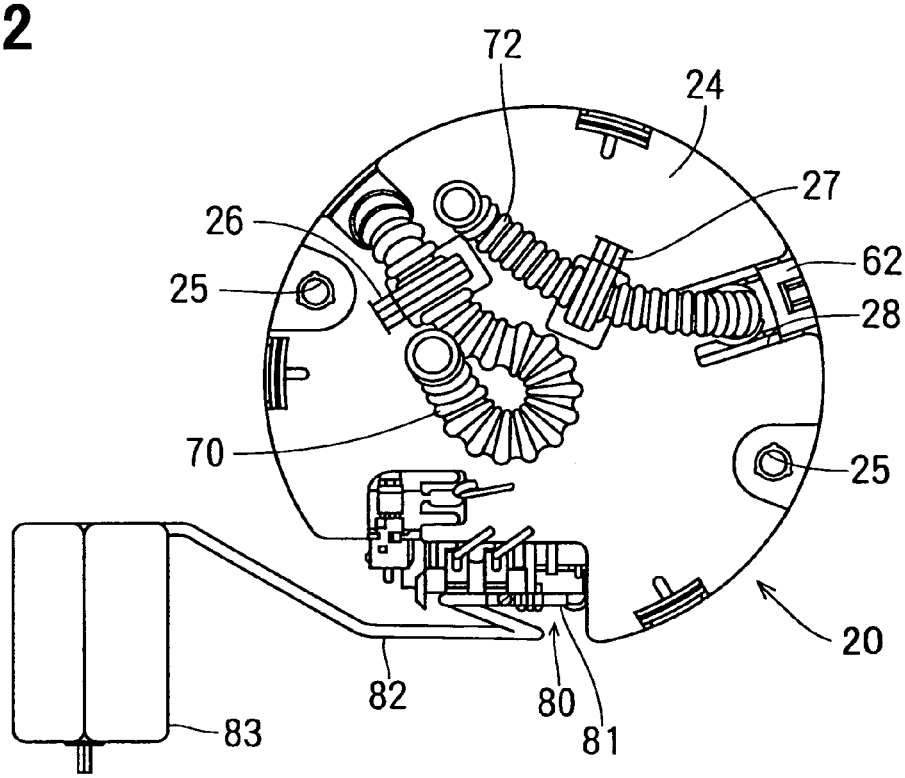
FIG. 2 is a top view when being viewed from the arrow II in FIG. 1.
Figure 3:
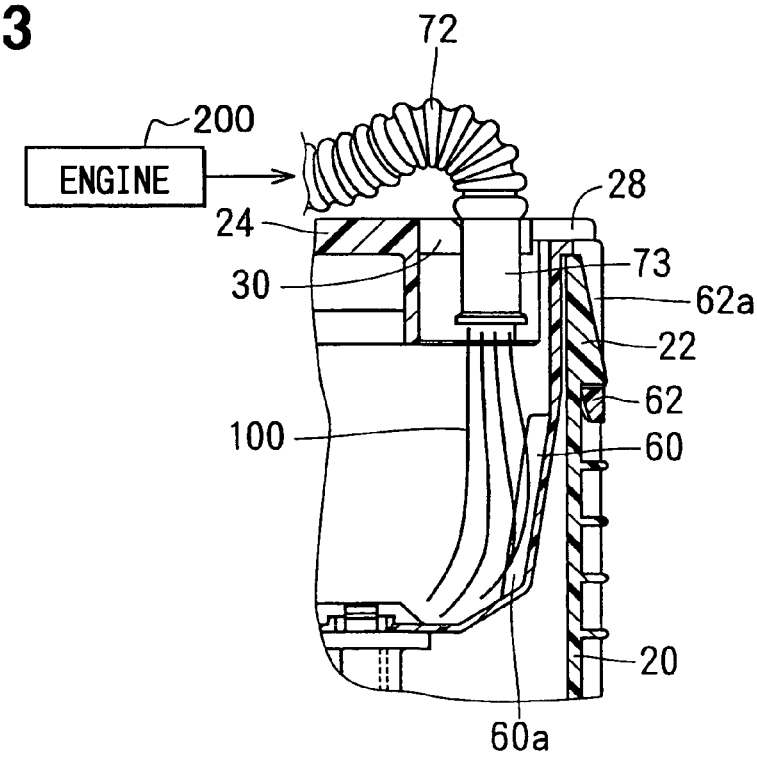
FIG. 3 is a partially cross sectional view showing the fuel supply apparatus.

Next, the structure of the fuel feed apparatus is specifically described in reference to FIGS. 1 to 4B. Here, FIG. 3 is a cross sectional view taken along the line III—III in FIG. 4A.

Figure 4A:
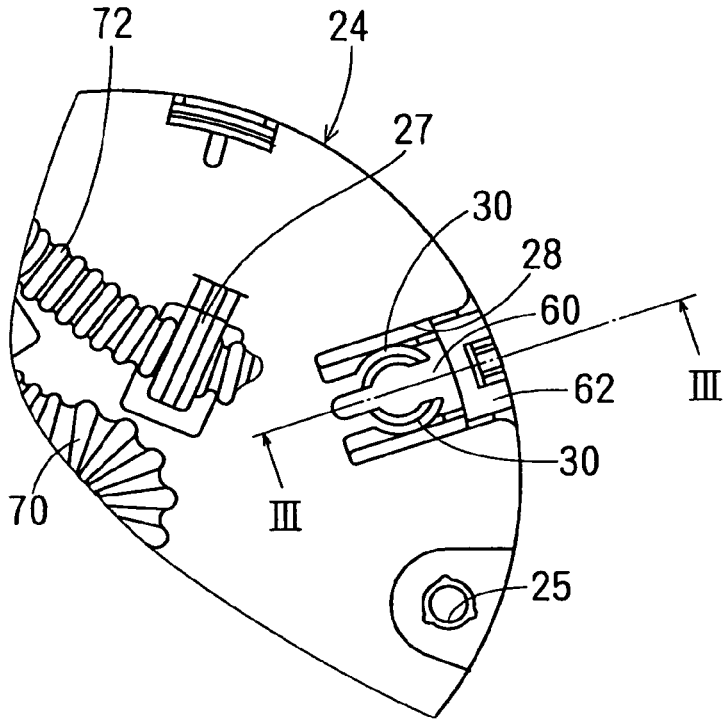
FIG. 4A is a top view showing a bellows pipe supported by a support member of a sub-tank lid when being viewed from the arrow IVA in FIG. 1.
Figure 4B:
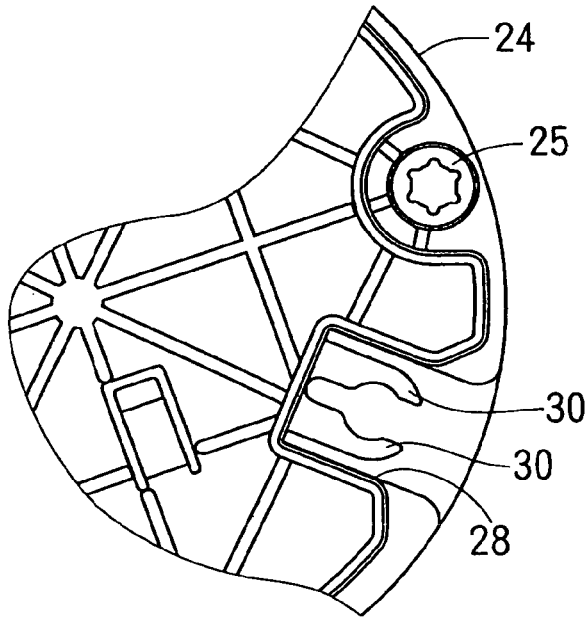
FIG. 4B is a bottom view showing the sub-tank lid when being viewed from the inside of the sub-tank.

The sub-tank lid 24, which is made of resin, closes an opening formed in the sub-tank 20. The opening of the sub-tank 20 is formed on the side of the lid member 12. The insertion portions 25, latches 26, 27 (FIGS. 1, 2), and a pair of claws 30 (FIGS. 3, 4A, 4B) are formed on the sub-tank lid 24. The metallic pipes 16 are inserted into the insertion portions 25. The bellows pipes 70, 72 are caught by the latches 26, 27 (FIGS. 1, 2). As shown in FIGS. 4A, 4B, a notch 28 is formed on the outer periphery of the sub-tank lid 24. The pair of claws 30 (FIG. 3) has a semi-circular inner peripheral shape to serve as a support member. The claws 30 are formed in the notch 28 to oppose to each other. The pair of claws 30 can expand in a direction away from each other. The claws 30 are expanded, and a downstream end 73 of the bellows pipe 72 is inserted between the claws 30, so that the bellows pipe 72 is inserted between the pair of claws 30 to be supported by the claws 30. The bellows pipe 72 serves as a return pipe.

The suction filter 44 shown in FIG. 1 is connected to a suction port of the fuel pump 42 such that the suction filter 44 contacts with the inner wall of the bottom of the sub-tank 20. The suction filter 44 is covered at its outer periphery with nonwoven fabric as a filter medium. That is, the suction filter 44 is at least partially formed of a vibration damping material. The suction filter 44 removes relatively large foreign matters contained in fuel drawn from the sub-tank 20. A bottom of the nonwoven fabric on the suction filter 44 is in contact with the inner wall of the bottom of the sub-tank 20.

The pump casing 50 is made of resin. The pump casing 50 includes a casing body 52 and a bracket 55. The casing body 52 is formed to be bottomed cylindrical shaped to cover the outer periphery of the fuel pump 42. The peripheral wall of the casing body 52 is formed to be mesh-shaped or lattice-shaped such that the peripheral wall includes portions devoid of resin. Thereby, a quantity of resin used for the whole pump casing 50 can be reduced, and the pump casing 50 can be reduced in weight. The casing body 52 includes a discharge portion 53 at the top thereof. The discharge portion 53 is fitted onto a discharge port 43 of the fuel pump 42 to be joined to the fuel pump 42. The discharge portion 53 is coupled to the bellows pipe 70 connected to a fuel discharge port of the lid member 12. The bracket 55 engages with the casing body 52 that is located below the fuel pump 42 to support the fuel pump 42.

As referred to FIGS. 1, 3, two arms 60 are connected together via a connection 64. The arms 60 are connection members. One ends of the arms 60 engage with projections 54 provided to the top of the casing body 52. As shown in FIG. 3, the arms 60 have engagements 62 to the other ends thereof. The engagements 62 engage with claws 22 provided to the outer peripheral wall of the sub-tank 20. The engagements 62 extend in a direction, in which the fuel pump 42 is mounted to the sub-tank 20. Windows 62*a* formed on the engagements 62 fit onto the claws 22. The engagements 62 fit onto and engage with the claws 22 of the sub-tank 20, so that the engagements 62 engage with the sub-tank 20.

The arms 60 include a slope (collision surface) 60*a* that is inclined toward the inner periphery of the sub-tank 20. The slope 60*a* is directed from upper portions of the arms 60 to lower portions of the arms 60. The lower portions of the arms 60 engage with the casing body 52. The upper portions of the arms 60 engage with the sub-tank 20. The slopes 60*a* are defined by a smooth plane.

As shown in FIG. 1, the bellows pipe 70 connects the discharge portion 53 of the pump casing 50 with the fuel supply portion provided to the lid member 12. The bellows pipe 72 has one end thereof connected to the fuel return portion provided to the lid member 12. The bellows pipe 72 has the downstream end 73 on the other end thereof. The downstream end 73 is inserted between the claws 30 provided to the sub-tank lid 24, and supported by the claws 30 as described above. One of the arms 60 of the pump casing 50 is positioned downward in the vertical direction of the downstream end 73 of the bellows pipe 72 supported on the sub-tank lid 24.

As referred to FIG. 2, a sender gauge 80 includes a sensor portion 81, an arm 82, and a float 83. The sensor portion 81 is arranged in a recess formed on the outer peripheral wall of the sub-tank 20. The sensor portion 81 detects a residual quantity of fuel in the fuel tank 1 in accordance with movement of the float 83 connected to the sensor portion 81.

The downstream end 73 of the bellows pipe 72 is mounted to the sub-tank 20. Claws 30, which are provided to the sub-tank lid 24, support the downstream end 73 of the bellows pipe 72. The sub-tank lid 24 covers at least a part of the opening of the sub-tank 20. Return fuel comes back into the sub-tank 20 through the bellows pipe 72. With such construction, the distance between the downstream end 73 of the bellows pipe 72 and a fuel level in the sub-tank 20 becomes small. Thereby, kinetic energy of return fuel flowing from the bellows pipe 72 can be reduced, so that return fuel can be restricted from striking against fuel in the sub-tank 20. Accordingly, it is possible to reduce sound of collision, which is generated when return fuel strikes against fuel in the sub-tank 20, and vapor generated from fuel in the sub-tank 20.

Surplus fuel on the side of the engine 200 comes back into the sub-tank 20 by way of the bellows pipe 72. The bellows pipe 72 extends through the upper wall of the fuel tank to the sub-tank 20. When the bellows pipe 72 extends to the upper side of the sub-tank 20, the bellows pipe 72 may increase in length, and the bellows pipe 72 may swing. However, in the structure of this embodiment, the claws 30 provided to the sub-tank lid 24 support the downstream end 73 of the bellows pipe 72, so that the bellows pipe 72 is capable of being restricted from swinging.

When fuel, which comes back into the sub-tank 20 through the bellows pipe 72, strikes directly against fuel in the sub-tank 20, return fuel strikes violently against fuel in the sub-tank 20. Accordingly, sound of collision of fuel becomes loud, and vapor may be generated from fuel in the sub-tank 20.

However, as referred to FIG. 1 in this embodiment, surplus fuel on the side of the engine 200 returns from the fuel return portion of the lid member 12 into the sub-tank 20 through the bellows pipe 72. At this time, return fuel 100 (FIG. 3) flowing from the bellows pipe 72 into the sub-tank 20 strikes against the slope 60*a* of the arm 60, and smoothly falls in the sub-tank 20.

Therefore, return fuel, which comes back from the bellows pipe 72 into the sub-tank 20, decreases in kinetic energy. Thus, return fuel flowing from the bellows pipe 72 is restricted from striking directly against fuel in the sub-tank 20. Accordingly, collision noise, which is generated when return fuel strikes against fuel in the sub-tank 20 after striking against the arm 60, decreases. Further, kinetic energy, with which return fuel strikes against fuel in the sub-tank 20, decreases, so that vapor generated from fuel in the sub-tank 20 is reduced.

The collision surface of the arms 60 is arc-shaped. Accordingly, return fuel strikes against the arms 60, and smoothly falls in the sub-tank 20. As a result, sound of collision of the fuel can be reduced, and vapor generated from fuel in the sub-tank 20 can be reduced.

Vibration generated by the fuel pump 42 is absorbed by the elastic arms 60, so that vibration is not apt to be transmitted to the sub-tank 20. Besides, the nonwoven fabric on the suction filter 44 is in contact with the inner wall of the bottom of the sub-tank 20, so that vibration generated by the fuel pump 42 can be restricted from transmitting to the sub-tank 20 via the suction filter 44.

Each arm 60 serves as a collision member, so that an additional collision member need not to be provided. Accordingly, the number of parts can be reduced.

The arms 60 engage with the outer peripheral wall of the sub-tank 20, that is, the outside of the sub-tank 20. A workspace is large in the outside of the sub-tank 20, so that the work of engaging the arms 60 with the sub-tank 20 becomes easy.

(Other Embodiments)

Return fuel may return to fuel in the sub-tank 20 directly from the bellows pipe 72 without striking against the arms 60, as long as the downstream end 73 of the bellows pipe 72 is supported by a support member provided to the sub-tank lid 24.

The downstream end 73 of the bellows pipe 72 may be supported by a support member provided to the sub-tank 20, or may be put in a free state of not being supported, as long as return fuel flowing from the bellows pipe 72 strikes against the arms 60 (collision member), and returns into the sub-tank 20. In this case, a construction without the sub-tank lid 24 is possible.

The collision surface of the arm 60 may have a smooth flat plane or a smooth arc-shape. An exclusive collision member, against which return fuel strikes, may be provided in addition to the arms 60. Such collision member may be optional in shape, as long as the collision member strikes against return fuel and restricts return fuel from directly striking against fuel in the sub-tank 20.

The fuel filter is mounted in the supply path to remove foreign matters contained in fuel discharged from the fuel pump 42, while fuel is supplied from the fuel tank 1 to the engine 200 through the supply path. The fuel filter may be mounted in the sub-tank 20 or the like in a manner to surround the outer periphery of the fuel pump 42. In this case, return fuel may decrease in kinetic energy by causing return fuel to strike against a part of a casing of the fuel filter.

In this embodiment, surplus fuel on the side of the engine 200 returns from the outside of the fuel tank 1 to the sub-tank 20 through a fuel pipe. The fuel pipe extends between the fuel tank and the engine. However, return fuel may come back from the fuel tank 1 or the like to the sub-tank 20, as long as the return fuel comes back from a portion between the discharge port 43 of the fuel pump 42 and the engine.

Various modifications and alternations may be diversely made to the above embodiments without departing from the spirit of the present invention.

What is claimed is:

1. A fuel feed apparatus that pumps fuel in a fuel tank to an outside of the fuel tank, the fuel feed apparatus comprising:

a sub-tank that is accommodated in the fuel tank, the sub-tank defining an opening;

a sub-tank lid that covers at least a part of the opening of the sub-tank;

a return pipe, wherein return fuel flows into the sub-tank through the return pipe; and a pump module that is accommodated in the sub-tank, wherein the return pipe has a downstream end that is mounted on an upper side of the sub-tank, the sub-tank lid includes a support member that supports the downstream end, the pump module includes a fuel pump that pumps fuel in the sub-tank, the pump module further includes a suction filter that is connected to a suction port of the fuel pump, and the sub-tank accommodates the suction filter.

2. The fuel feed apparatus according to claim 1, wherein return fuel flows into the sub-tank through the downstream end of the return pipe.

3. The fuel feed apparatus according to claim 2, wherein return fuel flows from an internal combustion engine into the sub-tank through the downstream end of the return pipe.

4. The fuel feed apparatus according to claim 1, further comprising:

a collision member, wherein fuel, which flows into the sub-tank through the return pipe, collides against the collision member.

5. The fuel feed apparatus according to claim 4, wherein the collision member has a collision surface, fuel, which flows into the sub-tank through the return pipe, collides against the collision surface, and the collision surface is arc-shaped.

6. The fuel feed apparatus according to claim 4, further comprising:

a connection member that connects the pump module with the sub-tank, wherein the connection member serves as the collision member.

7. The fuel feed apparatus according to claim 1, wherein the downstream end of the return pipe is mounted on an upper side of the pump module.

8. A fuel feed apparatus that supplies fuel in a fuel tank to an outside of the fuel tank, the fuel feed apparatus comprising:

a sub-tank that is accommodated in the fuel tank;

a return pipe, wherein fuel flows into the sub-tank through the return pipe;

a collision member, wherein fuel flowing into the sub-tank through the return pipe collides against the collision member; and a pump module that is accommodated in the sub-tank, wherein the pump module includes a fuel pump that pumps fuel in the sub-tank, the pump module further includes a suction filter that is connected to a suction port of the fuel pump, and the sub-tank accommodates the suction filter.

9. The fuel feed apparatus according to claim 8, wherein the collision member has a collision surface, fuel, which flows into the sub-tank through the return pipe, collides against the collision surface, and the collision surface is arc-shaped.

10. The fuel feed apparatus according to claim 8, further comprising:

a connection member that connects the pump module with the sub-tank, wherein the connection member serves as the collision member.

11. The fuel feed apparatus according to claim 10, wherein the connection member is elastic.

12. The fuel feed apparatus according to claim 10, wherein the connection member engages with an outer peripheral wall of the sub-tank.

13. The fuel feed apparatus according to claim 8, wherein the return pipe has a downstream end that is mounted on an upper side of the sub-tank, fuel is introduced into the sub-tank through the downstream end of the return pipe, and the sub-tank lid includes a support member that supports the downstream end.

14. The fuel feed apparatus according to claim 13, wherein fuel flows from an internal combustion engine into the sub-tank through the downstream end of the return pipe.

15. The fuel feed apparatus according to claim 13, wherein the downstream end of the return pipe is mounted on an upper side of a middle portion of the sub-tank in an axial direction of the sub-tank.

16. The fuel feed apparatus according to claim 10, wherein the suction filter is located between the fuel pump and an inner wall of the bottom of the sub-tank, the suction filter is in contact with both the fuel pump and the inner wall of the bottom of the sub-tank, and the suction filter is at least partially formed of a vibration damping material.

17. The fuel feed apparatus according to claim 16, wherein the suction filter is covered at its outer periphery with nonwoven fabric.

18. The fuel feed apparatus according to claim 8, wherein the downstream end of the return pipe is mounted on an upper side of the pump module, and the pump module serves as the collision member.

19. The fuel feed apparatus according to claim 18, wherein the suction filter is located between the fuel pump and an inner wall of the bottom of the sub-tank, the suction filter is in contact with both the fuel pump and the inner wall of the bottom of the sub-tank, and the suction filter is at least partially formed of a vibration damping material.

20. The fuel feed apparatus according to claim 19, wherein the suction filter is covered at its outer periphery with nonwoven fabric.

21. A fuel feed apparatus that pumps fuel in a fuel tank to an outside of the fuel tank, the fuel feed apparatus comprising:

a sub-tank that is accommodated in the fuel tank, the sub-tank defining an opening;

a sub-tank lid that covers at least a part of the opening of the sub-tank;

a return pipe, wherein return fuel flows into the sub-tank through the return pipe; and a collision member, wherein the return pipe has a downstream end that is mounted on an upper side of the sub-tank, the sub-tank lid includes a support member that supports the downstream end, fuel that flows into the sub-tank through the return pipe collides against the collision member, and the downstream end faces the collision member.

22. The fuel feed apparatus according to claim 21, further comprising:

a pump module that is accommodated in the sub-tank, wherein the pump module includes a fuel pump that pumps fuel in the sub-tank, the pump module further includes a suction filter that is connected to a suction port of the fuel pump, and the sub-tank accommodates the suction filter.

23. The fuel feed apparatus according to claim 21, wherein the collision member is spaced from the fuel pump.

24. The fuel feed apparatus according to claim 21, wherein the collision member is located on the side of the downstream end with respect to the fuel pump.

* * * * *